US007076976B1

(12) United States Patent
Goldman

(10) Patent No.: US 7,076,976 B1
(45) Date of Patent: Jul. 18, 2006

(54) INERTIAL BLOCKING MECHANISM

(76) Inventor: Ilan Goldman, 3 Hayasmin Street, Herzliya, 46631 (IL)

( * ) Notice: Subject to any disclaimer, the term of this patent is extended or adjusted under 35 U.S.C. 154(b) by 0 days.

(21) Appl. No.: 11/102,724

(22) Filed: Apr. 11, 2005

(51) Int. Cl.
*E05B 67/36* (2006.01)

(52) U.S. Cl. ..... 70/33; 70/38 A; 70/233

(58) Field of Classification Search ..... 70/32–34, 70/38 A, 233
See application file for complete search history.

(56) References Cited

U.S. PATENT DOCUMENTS

| | | | | |
|---|---|---|---|---|
| 3,583,741 | A * | 6/1971 | Breitschwerdt et al. | 292/216 |
| 3,901,057 | A * | 8/1975 | Coley, Sr. | 70/20 |
| 4,412,436 | A * | 11/1983 | Bechtiger | 70/272 |
| 4,422,522 | A * | 12/1983 | Slavin et al. | 180/281 |
| 5,052,728 | A * | 10/1991 | Fukumoto | 292/106 |
| 5,249,831 | A * | 10/1993 | Maniaci | 292/144 |
| 5,404,735 | A * | 4/1995 | Hsieh | 70/38 A |
| 5,561,996 | A * | 10/1996 | Chang | 70/247 |
| 6,047,575 | A * | 4/2000 | Larson et al. | 70/278.1 |
| 6,442,983 | B1 * | 9/2002 | Thomas et al. | 70/38 A |
| 6,474,122 | B1 * | 11/2002 | Davis | 70/278.3 |
| 6,761,051 | B1 * | 7/2004 | Tsai | 70/38 B |

FOREIGN PATENT DOCUMENTS

| | | | |
|---|---|---|---|
| DE | 3919509 | * | 12/1990 |
| EP | 1030010 | * | 2/2000 |
| GB | 21444483 | * | 3/1985 |
| WO | WO 90/15910 | * | 12/1990 |
| WO | WO 2004/072418 | * | 8/2004 |
| WO | WO 2004/072418 A1 | | 8/2004 |

* cited by examiner

*Primary Examiner*—Suzanne Dino Barrett
(74) *Attorney, Agent, or Firm*—Nath & Associates PLLC; Gary M. Nath; Gregory B. Kang

(57) ABSTRACT

A mechanical device such as a lock with anti-shock arrangement, comprising a locking member adapted for linear motion. The anti-shock arrangement comprises a balancing member mounted for linear motion substantially parallel to the locking member motion and a pivotally supported lever with two ends and a pivoting axis therebetween. The locking member abuts one of the ends and the balancing member abuts the other end, the abutment being maintained by a biasing means such as a spring. The lever has substantially zero moment of inertia with respect to its pivoting axis. The locking member, for example an armature of a bi-stable solenoid, is held in a blocked position of the device by a permanent magnet. Upon a shock applied to the device, the locking member and the balancing member create inertial forces substantially balancing each other, while vibration forces are cancelled by the abutment arrangement and the permanent magnet.

19 Claims, 3 Drawing Sheets

INERTIAL BLOCKING MECHANISM

FIELD OF THE INVENTION

This invention relates to electric or electronic locks, more specifically to movable locks with solenoid servomechanism.

BACKGROUND OF THE INVENTION

Electronic and electrically powered locks are known in many varieties. All kinds of them use some electrical servomechanism to block the locking-unlocking function such as moving a latch or a bolt or to perform the locking-unlocking itself. Most often, the servomechanism is a solenoid which is a simple, rugged, low cost, reliable and durable mechanism. In a solenoid mechanism, the armature performs a simple linear or swinging motion under the action of electromagnetic forces and elastic elements. It may be held in one or more positions by a permanent magnet, as in the known bi-stable solenoid.

The simplicity of the motion is however accompanied by a major problem, which is that the armature may be moved also by an inertial force. Such force may be created by a shock applied on the lock as a whole, especially on a pendant padlock, but also on safes, cassettes, etc. Also, vibrator may be used to create periodical acceleration in parts of a lock. In this way, a solenoid mechanism may be switched into unblocked or open state without any key or coded input. Many complicated ways have been developed to overcome this problem. They require complex additional parts, space in the padlock and are not reliable in all positions of the padlock.

For example, WO 2004/072418 to the same inventor discloses an anti-shock arrangement comprising a first element mounted to the armature and a second element fixed to the solenoid stator. The first element is engaged to the second element so as to perform a helical motion when the armature performs the linear motion. The helical motion is associated with overcoming a predetermined friction force, thereby preventing the two motions under shock applied on the whole device along the armature axis but allowing the linear motion under the magnetic action of the solenoid coil.

U.S. Pat. No. 5,249,831 describes a lock having a counterweight connected through a lever to a spring-actuated lock bolt on a safe to balance out any inertial forces tending to move the bolt out of its locking position when the safe is struck a heavy blow.

U.S. Pat. No. 4,412,436 describes a time lock for bank vault doors with a shock-resistant plunger latching mechanism having a relatively massive counterweight to oppose dynamic forces during shocks. The counterweight is balanced by a spring so as to unload the clock mechanism which blocks and unblocks a door bolt. A gear train is introduced between the locking device and a relatively small mass to increase the virtual inertia of the system, and an elastic link is provided between the input of the lock and the mass enabling the system to absorb vibrations at the input.

SUMMARY OF THE INVENTION

In accordance with the present invention, there is provided a mechanical device such as a lock with anti-shock arrangement, comprising a locking member adapted for linear motion from a first to a second position by a control force and allowing to be moved from the first to the second position by a first inertial force created by a shock applied to the device in suitable direction. The anti-shock arrangement comprises a balancing member mounted for linear motion substantially parallel to the locking member motion and a pivotally supported lever with two ends and a pivoting axis therebetween. One of the ends is linked to the locking member and the other is linked to the balancing member. The balancing member creates, upon said shock, a second inertial force applied to the locking member via the lever, the second inertial force substantially balancing out the first inertial force. The device is characterized in that the link between the lever and the locking member, and between the lever and the balancing member is by abutment, the anti-shock arrangement comprising a biasing means urging at least one of the locking member and the balancing member towards the lever so as to maintain the abutment.

The biasing means may be for example a spring means urging the balancing member towards the lever.

The locking member may be an armature of a bi-stable solenoid, the first position being a blocked position of the device, the armature being held in the first position by a permanent magnet.

The lever is preferably formed and supported so as to have substantially zero moment of inertia with respect to its pivoting axis.

The device may have a moveable latch, and then preferably the locking member in the first position is adapted to block the latch from motion, while in the second position the locking member is adapted to release the latch, and the linear motion of the locking member is transverse to the motion of the latch.

The moveable latch preferably has a profiled portion with a recess, the locking member having a profiled opening matching the profiled portion and allowing motion of the latch when the locking member is in the second position while when the locking member is in its first position, edge of the profiled opening engages the recess and blocks the latch from motion.

The pivoted lever may be formed as a cylinder pivotally supported in a cylinder recess, the profiled opening being made within the perimeter of the cylinder which further has a first step adapted for abutment of the locking member and a second step adapted for abutment of the balancing member.

The two steps are preferably made within the perimeter of the cylinder. The first step may have a side wall formed to abut a side of the locking member when the latter reaches the second position and the second step may have a side wall formed to abut a side of the balancing member.

The anti-shock arrangement of the present invention balances inertial forces created by a shock applied to the mechanical control system such as a padlock so that the locking member such as a solenoid magnet armature cannot be moved.

The abutment link between the locking member and the balancing member via the lever ensures that mechanical forces are transmitted to and from the lever in the abutment direction only. Thereby, the anti-shock arrangement is also proof to vibration forces combined with friction.

BRIEF DESCRIPTION OF THE DRAWINGS

In order to understand the invention and to see how it may be carried out in practice, embodiments will now be described, by way of non-limiting examples only, with reference to the accompanying drawings, in which.

DETAILED DESCRIPTION OF THE EMBODIMENTS

Figure 1:
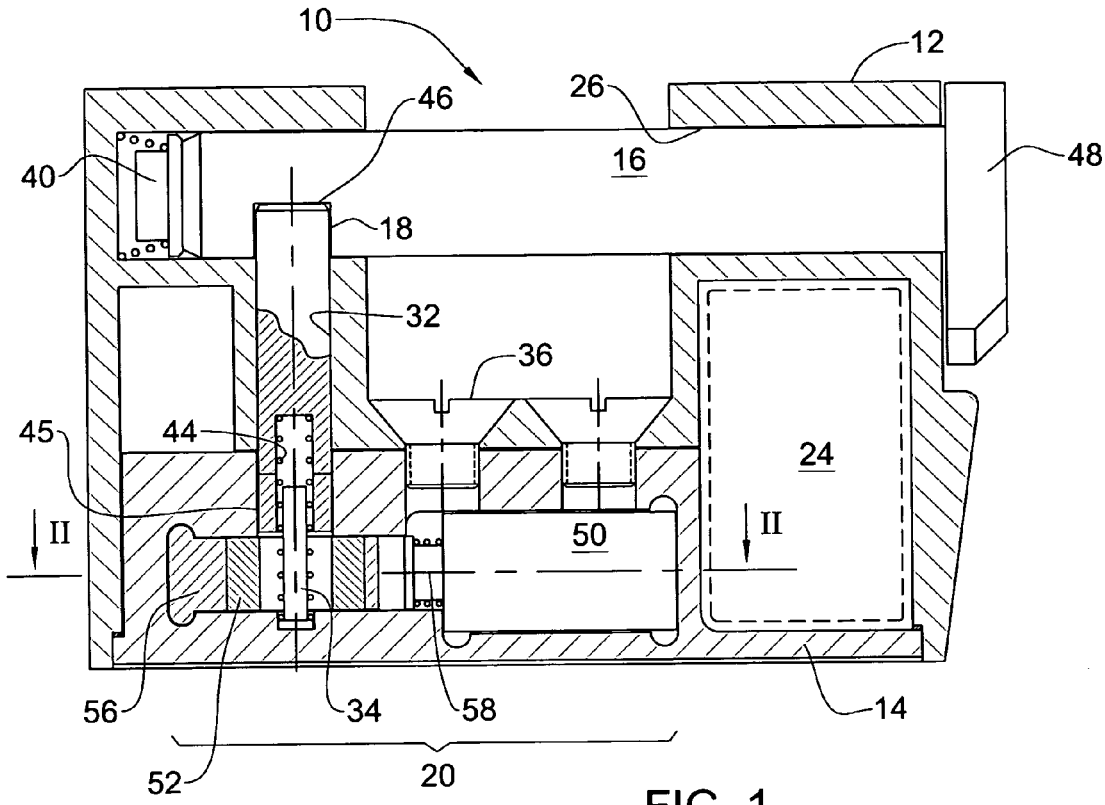
FIG. 1 is a frontal sectional elevation of an electronic padlock with anti-shock arrangement according to the present invention.
Figure 2:
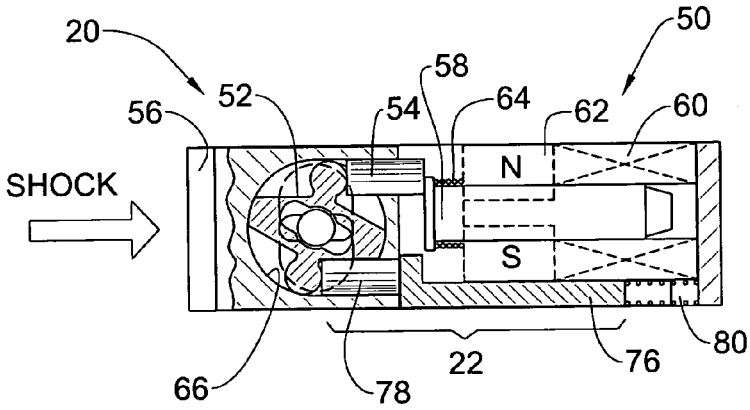
FIG. 2 is a partial sectional view of the padlock of FIG. 1 in the plane II—II, with a latch in locked state.
Figure 3:
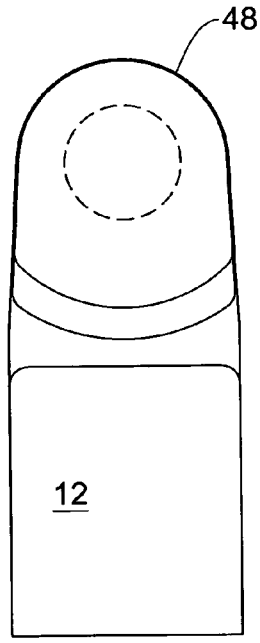
FIG. 3 is a side view of the padlock in FIG. 1.

With reference to FIGS. 1, 2 and 3, a padlock 10 of the present invention comprises a housing 12 with a base plate 14, a lock bolt 16, a latch pin 18, a blocking assembly 20 including an anti-shock arrangement 22, and an electronic control circuit 24 with battery (not shown).

Figure 4:
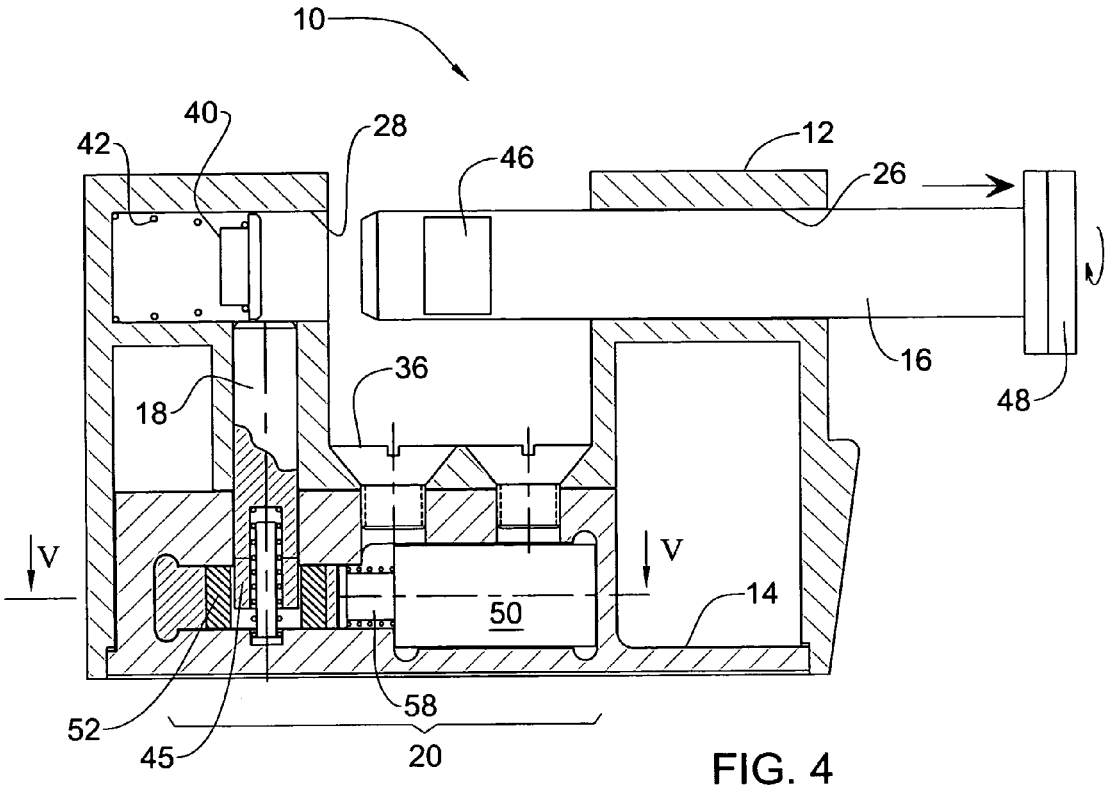
FIG. 4 is a frontal sectional elevation of the padlock of FIG. 1, in open state.

With reference also to FIG. 4, the housing 12 is a sturdy hollow U-shaped body with a through cylindrical bore 26 extending into a blind bore 28, and another cylindrical bore 32 perpendicular to and crossing the bore 28. The base plate 14 is mounted to the housing 12 by means of two screws 36. The housing further accommodates a dummy plug 40 in the bottom of the blind bore 28 urged by a compression spring 42 towards the opening of the bore 28.

The latch pin 18 is slidingly accommodated in the bore 32 and is urged towards the bore 28 by a second compression spring 44 supported by a pin 34. The latch pin has a profiled tail 45.

The lock bolt 16 has a notch 46 sized to receive the lock pin 18, and a handle 48. The lock bolt 16 is slidingly and rotatably disposed in the bores 26–28.

Figure 5:
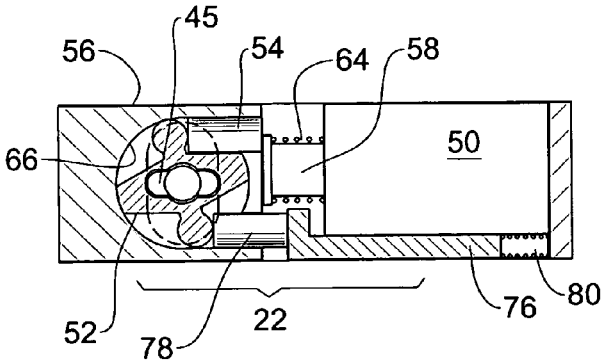
FIG. 5 is a partial sectional view of the padlock of FIG. 4 in the plane V—V, with the latch in unlocked state.

With reference also to FIG. 5, the blocking assembly 20 comprises a bi-stable solenoid 50, a latch lever 52, an intermediate pin 54, and a latch housing 56. The solenoid 50 has a movable armature 58, an electromagnetic coil 60 and a permanent magnet 62. A compression spring 64 urges the armature 58 away from the magnet 62. The solenoid 50 has two stable states: a contracted state with armature 58 attracted and held by the magnet 62 and the spring 64 compressed (as shown in FIG. 2), and an extended state with armature 58 urged away from the magnet (as shown in FIG. 5). The solenoid 50 may be toggled between the two states by energizing the coil 60 with direct current with appropriate polarity. The intermediate pin 54 is mounted for sliding in the latch housing 56, so as to abut the armature 58 and the latch lever 52.

The latch housing 56 is formed for snug mounting in the base plate 14. It has a round bore 66 for accommodating the latch lever 52, coaxial with the latch pin 18, and two channels parallel to the solenoid axis, one of them accommodating the intermediate pin 54.

Figure 6:
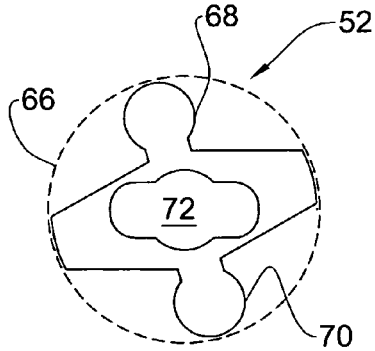
FIG. 6 is an enlarged view of the latch lever of the padlock in FIG. 1.

The latch lever 52 is mounted for free rotation (pivoting) in the bore 66. With reference to FIG. 6, the latch lever 52 has two steps 68 and 70, and a profiled bore 72. The two steps 68 and 70 provide contact points for abutment of the pins 54 and 78 (below). Sides of the steps are formed at suitable angle so as to abut the pins' sides and prevent further rotation of the latch lever after reaching a predetermined angle, as seen in FIGS. 2 and 5. The bore profile is shaped to allow passage of the profiled tail 45 only when the latch lever 52 is disposed at a predetermined angle in the latch housing 56. The overall shape of the latch lever 52 is symmetric with respect to the bore 66. Thus, the latch lever 52 constitutes a first-class lever supported for pivoting in a middle point with respect to forces applied at the steps 68 and 70.

The anti-shock arrangement 22 comprises a pushing rod (balancing member) 76, a second intermediate pin 78, and a compression spring 80. The pushing rod 76 is supported for sliding in a channel beside the solenoid and parallel to the solenoid axis. The intermediate pin 78 is mounted for sliding in the second channel of the latch housing 56, so as to abut the pushing rod 76 and the latch lever 52. The spring 80 is disposed so as to urge the pushing rod 76 towards the latch lever 52, thereby maintaining the pushing rod 76, intermediate pin 80 intermediate pin 78, latch lever 52, intermediate pin 54 and armature 58, in permanent abutment. Masses of the pins 54 and 78 are selected to be substantially equal, and the mass of the pushing rod 76 is equal to that of the armature 58.

The electronic control circuit 24 is adapted to energize, upon command, the solenoid 50. Its particular structure is not relevant to the patent.

The padlock 10 operates in the following way. With reference to FIGS. 1 and 2, in a closed state of the padlock, the bolt 16 is inserted in the bore 26–28 until the handle 48 abuts the housing 12, with the notch 46 facing the latch pin 18. In this position of the lock bolt 16, the pin 18 enters the notch 46 under the action of the spring 44, thereby preventing an axial extraction of the lock bolt. The control circuit 24 energizes the coil 60 so that the armature 58 of the solenoid 50 is retracted and sticks to the magnet 62. The latch lever 52 of the blocking assembly 20 turns to enter under the edge of the latch pin 18 urged by the spring 80 via the pushing rod 76 and the intermediate pin 78, thereby preventing any return of the latch pin 18. The U-shape of the padlock is now closed and the lock bolt 16 is blocked.

In order to unblock the lock bolt and to let open the padlock 10, the control circuit 24 energizes the coil 60 for a moment to create electromagnetic force opposite to the attraction force of the permanent magnet 62. Thereby, the armature 58 is released from the magnet 62, and the spring 64 pushes the armature out of the solenoid (see FIGS. 4 and 5). The armature 58 pushes the latch lever 52 via the intermediate pin 54 to turn in the bore 66 of the latch housing 56 so that the profiled bore 72 aligns with the profiled tail 45 and the latter is free to move into the former. While turning, the latch lever 52 pushes the intermediate pin 78 and displaces the pushing rod 76, compressing the spring 80. Strengths of the springs 64 and 80 are accordingly selected.

Now the lock bolt 16 can be turned by hand using the handle 48. In the process of turning, the bottom of the notch 46 presses the latch pin 18 against the action of the spring 44, to sink the pin tail 45 in the bore 32. At about ¼ turn and more from the blocked state, the lock bolt 16 pushes the latch pin 18 entirely into the bore 32, whereby the lock bolt can be extracted axially, as shown in FIG. 4. In the axial motion, the lock bolt 16 is followed by the dummy plug 40, under the action of the spring 42. The dummy plug 40 takes the place of the lock bolt 16 over the end of the latch pin 18, thereby preventing an irreversible entry of the latter into the bore 26.

In a few seconds, the control circuit 24 energizes the coil 60 for a moment to create electromagnetic force co-directional to the attraction force of the permanent magnet 62. Thereby, the armature 58 is retracted into the solenoid and further held by the magnet 62, compressing the spring 64. The latch lever 52 now is urged only by the pushing rod 76 via the pin 78. If the lock bolt 16 were turned and extracted as explained above, the profiled pin tail 45 would be inside the profiled bore 32 and would not let the latch lever 54 to rotate back into its blocked position. However, the blocking assembly is now preloaded: when the lock bolt 16 is returned (manually) to its closed position with the notch 46 opposite the latch pin 18, the latch pin 18 will sink into the recess notch pushed by the spring 44, the profiled tail 45 will release the latch lever 52 and the latter will rotate to its blocked position under the edge of the latch pin 18, automatically, without further energizing the solenoid coil.

If the lock bolt 16 is not turned from its closed position during that few seconds, then the latch lever 52 will immediately rotate back to its blocked position under the edge of the latch pin 18.

The anti-shock arrangement 22 operates in the following way. If a shock (acceleration) is applied to the padlock in a direction parallel to the solenoid axis, as shown in FIG. 2, the armature 58 which can slide in the same direction, will tend to exert an inertial force on the latch lever 52 (via the pin 54) and to separate from the magnet 62. In the absence of an opposing force, the armature 58 may entirely separate from the magnet and, aided by the spring 64, may turn the latch lever 52 into alignment with the profiled tail 45 (the position shown in FIG. 5) thereby unblocking the latch pin 18 and allowing to open the padlock.

However, as mentioned above, the pushing rod 76 has the same mass as the armature 58 and is mounted for sliding parallel to the solenoid axis. Therefore, if a shock is applied, the pushing rod 76 will create a second inertial force, substantially the same as the force from the armature 58. Both forces act, via the respective intermediate pins 54 and 78, on steps 68 and 70 at different sides of the latch lever 58. Thereby, essentially equal and opposite moments are acting on the latch lever under shock applied to the padlock so that the latch lever cannot be turned. It will be appreciated that pins 54 and 78 behave substantially as integral parts of the armature and the pushing rod respectively, and their separate design is a matter of convenience.

The above anti-shock arrangement is also proof to vibration forces combined with friction. In some cases, it is possible, by applying vibrations to the padlock and simultaneously small moment to the handle 48, to create oscillating friction forces between the latch pin 18 and the latch lever 52 and oscillating inertial moment on the latch lever. When periods of low friction coincide with periods where the moment is directed to the unblocked position of the latch lever, the latter may "crawl" until the unblocked position is reached. For example, the safe lock in the U.S. Pat. No. 5,249,831 where a counterweight is positively connected to the lever may be opened by this method.

In the arrangement of the present invention, the link between the inertial masses (armature and pushing rod) and the latch lever is only by abutment so that they cannot pull the lever. Also, the form of the latch lever 58 has central symmetry so that linear vibrations or accelerations cannot create inertial torque with respect of the pivoting axis.

Advantageously, the blocked position of the latch pin 18 is associated with the retracted position of the armature 58 which is maintained by the attraction force of the permanent magnet 62, rather than with the outstanding position which is maintained by the balance between the elastic forces of the springs 64 and 80. In the first case, small vibration forces cannot overcome the magnet attraction which is a few times stronger than the elastic force of the spring 64. It would take a strong inertial force (shock) to move the armature against the attraction force of the magnet, but in such case the pushing rod 76 provides an opposite and equal inertial force, as explained above.

Additionally, the plane of motion of the blocking assembly (armature, pushing rod and the latch lever) is perpendicular to the latch pin operation motion. Thus, external forces applied to the latch pin cannot urge the blocking assembly. It will be appreciated that the profiled bore or recess accommodating the profiled tail of the latch may be arranged in another moving part associated with the blocking assembly, for example in the intermediate pin 54 or 78.

Figure 7:
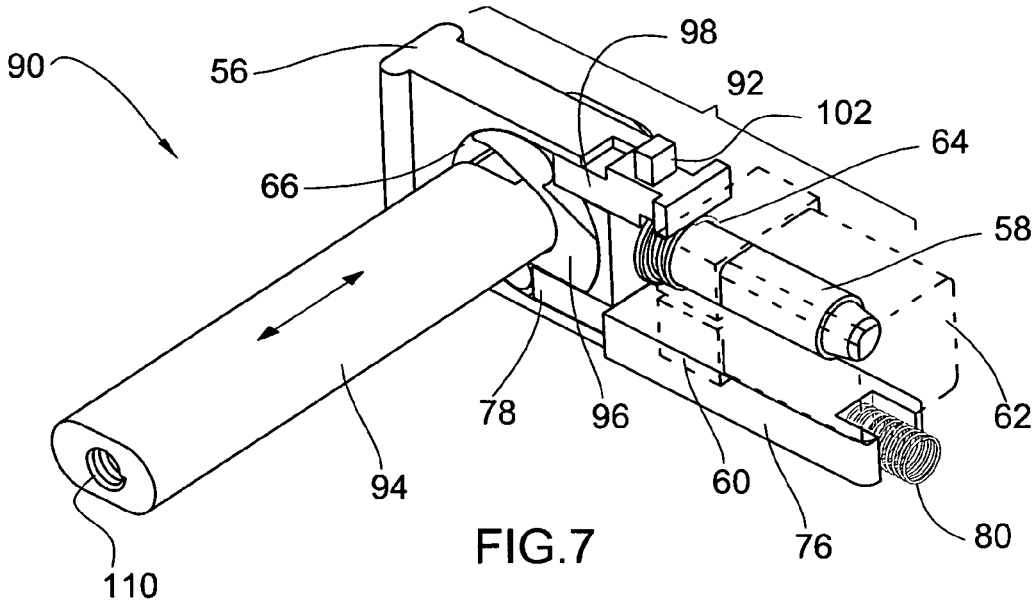
FIG. 7 is a perspective view of another locking mechanism with blocking device having an anti-shock arrangement according to the present invention.
Figure 9:
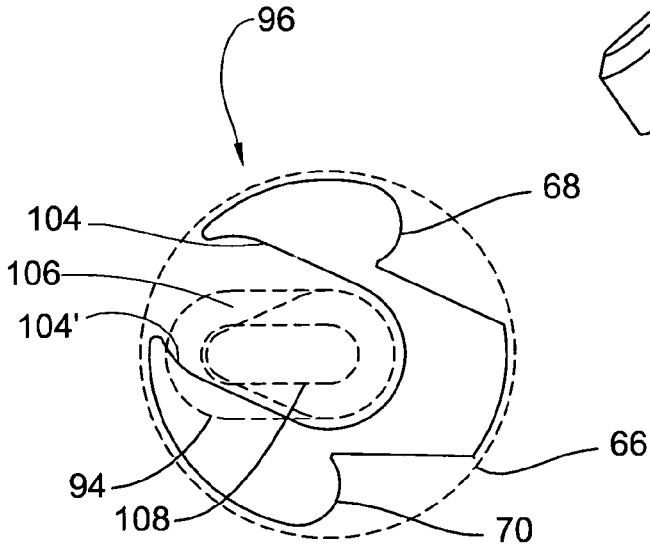
FIG. 9 is an enlarged view of the latch lever used in the locking mechanism of FIG. 7.
Figure 8:
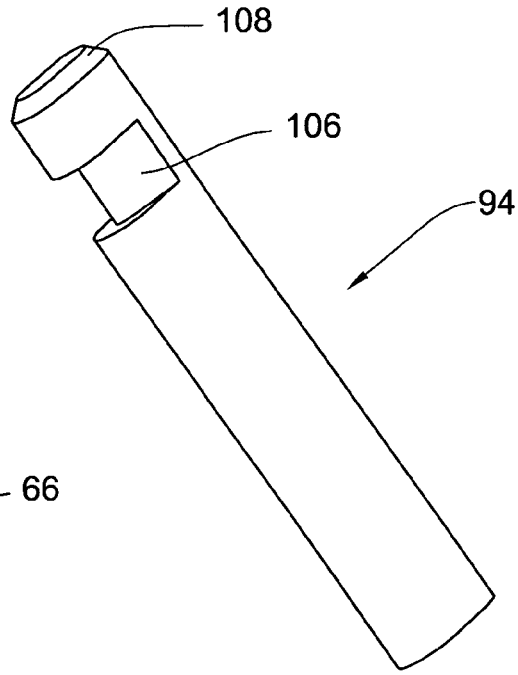
FIG. 8 is a perspective view of the locking bolt of the locking mechanism shown in FIG. 7.

Another embodiment of the anti-shock arrangement is shown in FIGS. 7, 8 and 9 where same numerals are used for essentially the same parts as in FIGS. 1 to 6. A perspective view of a locking mechanism 90 is shown generally in FIG. 7 without a housing. The locking mechanism comprises a blocking assembly 92 mountable, for example to a door frame, and a lock bolt 94 of profiled non-circular section mountable to a door.

The blocking assembly 92 includes a bi-stable solenoid (essentially the same as in FIG. 2, shown in broken lines), a latch lever 96, an intermediate pin 98, and a latch housing 56. The solenoid has a movable armature 58, coil 60, permanent magnet 62 and a compression spring 64. The intermediate pin 98 is mounted for sliding in the latch housing 56 so as to abut the armature 58 and the latch lever 96, and has a lug 102 which is accessible for manual opening of the locking mechanism.

The latch housing 56 has a round bore 66 for accommodating the latch lever 96, and two channels parallel to the solenoid axis, one of them accommodating the intermediate pin 98.

The latch lever 96 is mounted for free rotation (pivoting) in the bore 66. With reference to FIG. 9, the latch lever 96 has two steps 68 and 70, and a profiled recess 104. The recess profile is shaped to allow passage of the profiled lock bolt 94 when the latch lever 96 is disposed at a predetermined angle in the latch housing 56. As above, the latch lever 96 constitutes a first-class lever supported for pivoting about a middle point with respect to forces applied at the steps 68 and 70. The overall shape of the latch lever 96 has no central symmetry; however the shape is designed to have zero or negligible moment of inertia with respect to its pivoting axis (the axis of bore 66).

With reference to FIG. 8, the lock bolt 94 has a notch 104 sized to receive the edge (jaw 104') of the profiled recess 106 of latch lever 96. The lock bolt 94 is supported for sliding but not for rotation, for example in a door (supports are not shown). The front end 108 of the lock bolt is tapered (conical), and the rear end has a threaded bore 110 for mounting of a handle or servomechanism.

The anti-shock arrangement 22 of the blocking assembly 92 comprises a pushing rod 76, a second intermediate pin 78, and a compression spring 80, with similar features and functions as above.

The locking mechanism 90 operates essentially in the same way as the padlock 10 of FIGS. 1 to 6, considering that the lock bolt 94 plays the role of the latch pin 18. FIG. 7 shows a closed state of the locking mechanism, where the lock bolt 94 is inserted in the profiled recess 104 of the latch lever 96, the notch 106 being aligned with the latch lever thickness. The armature 58 is retracted and the latch lever 96 is turned, under the action of the spring 80, to engage the recess 106 with jaw 104', thereby preventing an axial extraction of the lock bolt 94. This position of the latch lever 96 is also shown in FIG. 9.

In order to unblock the lock bolt 94 and to let open the locking mechanism 90, the coil 60 is energized for a moment to release the armature 58. Under the action of the spring 64, the armature pushes and turns the latch lever 96 clockwise so that the profiled recess 104 aligns with the profiled section of the lock bolt 94. Now the lock bolt 94 can be pulled out of the latch lever 96 and the door can be opened.

In a few seconds, the coil 60 is energized for a moment in opposite direction to retract the armature 58 into the solenoid where it is held by the permanent magnet 62. The latch lever 96 is now rotated back (anticlockwise in FIG. 7) by the pushing rod 76 under the action of the spring 80.

In order to close the locking mechanism 90, the door is closed so that the lock bolt 94 is axially aligned opposite the profiled recess 104 of the latch lever 96, and then the lock bolt is pushed manually into the profiled recess. Indeed, initially the lock bolt profile is in angular misalignment with the recess profile (as seen in FIG. 9) but the conical part 108 first enters the recess 104 and forces the latch lever to rotate anticlockwise and align with the lock bolt profile. As the link between the latch lever 96 and the armature 58 is only by abutment (via the intermediate pin 98), forced anticlockwise rotation of the latch lever can not pull the armature 58 out of the solenoid. As soon as the lock bolt assumes a position where its notch 106 is aligned with the latch lever thickness, the latter turns clockwise and the jaw 104' engages the notch 106 automatically, whereby the locking mechanism 90 is closed as shown in FIG. 7.

The locking mechanism 90 may be used in a different way where the whole mechanism, including the lock bolt 90, is mounted in one integral part of a door, safe, etc. In such case, the lock bolt 94 may be assembled to a servomechanism by the threaded bore 110, and is adapted to go all the way through the profiled recess 104 (to the right in FIG. 7) and interact with other locking members (not shown). It will be appreciated that in this case, the locking of the lock bolt 94 will proceed substantially as the locking of the latch pin 18 in the first embodiment (FIG. 1). When the armature 58 is retracted into the solenoid and further held by the magnet 62, with the notch 106 still not aligned with latch lever 96, the latter will be preloaded by the spring 80 via the pushing rod 76 and the pin 78. As soon as the lock bolt 94 assumes a position where its notch 106 is aligned with the latch lever thickness, the latter will turn clockwise with the jaw 104' engaging the notch 106 automatically, without further energizing the solenoid coil.

Although a description of specific embodiments has been presented, it is contemplated that various changes could be made without deviating from the scope of the present invention. For example, the present invention could be modified and used in bank vaults, safes, cassettes, vehicle doors, and other devices.

The invention claimed is:

1. A mechanical device with anti-shock arrangement, comprising a locking member adapted for linear motion from a first to a second position by a control force and allowing to be moved from said first to said second position by a first inertial force created by a shock applied to said device in suitable direction, the anti-shock arrangement comprising a balancing member mounted for linear motion substantially parallel to the locking member motion, and a pivotally supported lever with two ends and a pivoting axis therebetween, one of said ends being linked to said locking member and the other of said ends being linked to said balancing member, said balancing member being able to create upon said shock a second inertial force applied to said locking member via said lever, said second inertial force substantially balancing out said first inertial force, wherein the link between said lever and said locking member, and between said lever and said balancing member is by abutment, said anti-shock arrangement comprising a biasing means urging at least one of said locking member and said balancing member towards said lever so as to maintain said abutment; and wherein said biasing means includes a spring means urging said balancing member towards said lever.

2. The device of claim 1, wherein said locking member is the armature of a bi-stable solenoid, said first position is a blocked position of said device, and said armature is held in said first position by a permanent magnet.

3. The anti-shock arrangement of claim 1, wherein said lever is formed so as to have substantially zero moment of inertia with respect to said pivoting axis.

4. The device of claim 1, wherein said pivoted lever is formed as a cylinder pivotally supported in a cylinder bore, said cylinder further having a first step adapted for abutment of said locking member and a second step adapted for abutment of said balancing member.

5. The device of claim 4, wherein the two steps are made within the perimeter of said cylinder.

6. The device of claim 1, wherein said device has a moveable latch, said locking member in said first position is adapted to block said latch from motion while in said second position said locking member is adapted to release the latch, and the motion of said latch is transverse to the linear motion of the locking member.

7. The device of claim 6, wherein said moveable latch has a profiled portion with a recess, said locking member has a profiled opening matching said profiled portion and allowing motion of the latch when the locking member is in said second position while when the locking member is in its first position, edge of said profiled opening engages said recess and blocks said latch from motion.

8. The device of claim 6, wherein the motion of said latch is transverse to the plane of rotation of the pivoted lever, said moveable latch has a profiled portion with a recess, said lever has a profiled opening matching said profiled portion and allowing motion of the latch therethrough when the locking member is in said second position, while when the locking member is in its first position, edge of said profiled opening engages said recess and blocks said latch from motion, said locking member and said balancing member being held in abutment with said lever by a spring means urging the balancing member to said lever.

9. The device of claim 6, wherein said pivoted lever is formed as a cylinder pivotally supported in a cylinder bore, said profiled opening being made within the perimeter of said cylinder.

10. A mechanical device with anti-shock arrangement, comprising a locking member adapted for linear motion from a first to a second position by a control force so as to be engaged by a perpendicular latching member and allowing to be moved from said first to said second position by a first inertial force created by a shock applied to said device in suitable direction, the anti-shock arrangement comprising a balancing member mounted for linear motion substantially parallel to the locking member motion, and a pivotally supported lever with two ends and a pivoting axis therebetween, one of said ends being linked to said locking member and the other of said ends being linked to said balancing member, said balancing member being able to create upon said shock a second inertial force applied to said locking member via said lever, said second inertial force substantially balancing out said first inertial force, wherein the link between said lever and said locking member, and between said lever and said balancing member is by at least partially perpendicular abutment, said anti-shock arrangement comprising a biasing means urging at least one of said locking member and said balancing member towards said lever so as to maintain said abutment.

11. The device of claim 10, wherein said biasing means includes a spring means urging said balancing member towards said lever.

12. The device of claim 10, wherein said locking member is the armature of a bi-stable solenoid, said first position is a blocked position of said device, and said armature is held in said first position by a permanent magnet.

13. The anti-shock arrangement of claim 10, wherein said lever is formed so as to have substantially zero moment of inertia with respect to said pivoting axis.

14. The device of claim 10, wherein said pivoted lever is formed as a cylinder pivotally supported in a cylinder bore, said cylinder further having a first step adapted for abutment of said locking member and a second step adapted for abutment of said balancing member.

15. The device of claim 14, wherein the two steps are made within the perimeter of said cylinder.

16. The device of claim 10, wherein said device has a moveable latch, said locking member in said first position is adapted to block said latch from motion while in said second position said locking member is adapted to release the latch, and the motion of said latch is transverse to the linear motion of the locking member.

17. The device of claim 16, wherein said moveable latch has a profiled portion with a recess, said locking member has a profiled opening matching said profiled portion and allowing motion of the latch when the locking member is in said second position while when the locking member is in its first position, edge of said profiled opening engages said recess and blocks said latch from motion.

18. The device of claim 16, wherein the motion of said latch is transverse to the plane of rotation of the pivoted lever, said moveable latch has a profiled portion with a recess, said lever has a profiled opening matching said profiled portion and allowing motion of the latch therethrough when the locking member is in said second position, while when the locking member is in its first position, edge of said profiled opening engages said recess and blocks said latch from motion, said locking member and said balancing member being held in abutment with said lever by a spring means urging the balancing member to said lever.

19. The device of claim 16, wherein said pivoted lever is formed as a cylinder pivotally supported in a cylinder bore, said profiled opening being made within the perimeter of said cylinder.

* * * * *